US005894743A

United States Patent [19]

Bredemeyer et al.

[11] Patent Number: 5,894,743

[45] Date of Patent: Apr. 20, 1999

[54] SINGLE NEEDLE BED MACHINE PROCESS FOR MANUFACTURING OF PILE WARP KNIT FABRIC

[75] Inventors: Jorg Bredemeyer, Obertshausen; Horst Jager, Heusentamm, both of Germany

[73] Assignee: Karl Mayer Textilmaschinenfabrik, Obertshausen, Germany

[21] Appl. No.: 08/967,568

[22] Filed: Nov. 10, 1997

[30] Foreign Application Priority Data

Nov. 16, 1996 [DE] Germany ..... 196 47 508

[51] Int. Cl.[6] ..... D04B 21/02

[52] U.S. Cl. ..... 66/84 R; 66/195; 66/207

[58] Field of Search ..... 66/195, 84 R, 66/207, 192

[56] References Cited

U.S. PATENT DOCUMENTS

| | | | |
|---|---|---|---|
| 4,986,091 | 1/1991 | Jager | 66/84 R |
| 5,058,399 | 10/1991 | Watisse et al. | 66/203 |
| 5,150,587 | 9/1992 | Bergmann | 66/195 |
| 5,520,022 | 5/1996 | Callaway | 66/194 |
| 5,664,441 | 9/1997 | Clerici | 66/193 |

FOREIGN PATENT DOCUMENTS

| | | |
|---|---|---|
| 1188754 | 11/1965 | Germany . |
| 69044 | 12/1971 | Germany . |
| 02088 | 7/1973 | Germany . |
| 4223226 | 11/1994 | Germany . |

*Primary Examiner*—Andy Falik
*Attorney, Agent, or Firm*—Omri M. Behr, Esq.

[57] ABSTRACT

A process and machine for the preparation of pile ware uses a single needle bedded warp knitting machine, having pile sinkers. During the swing-through of the guides subsequent to the underlap into the overlap position, first the ground threads and then the left pile threads, are laid to the rear of the needles, and run along these, with separation from each other. The pile sinkers are introduced into the space between the ground threads and the left pile threads, during or after the swing-through, and stay there until the knock-over of the stitch. The threads are provided to the guide bars in a one full/one empty order, only every second needle serving for stitch formation. The number of pile sinkers equals half of the number of needles. Right pile threads are provided which are overreached by the pile sinkers together with the ground threads laid about needles not serving for stitch formation and are then knocked over.

15 Claims, 4 Drawing Sheets

SINGLE NEEDLE BED MACHINE PROCESS FOR MANUFACTURING OF PILE WARP KNIT FABRIC

BACKGROUND OF THE INVENTION

1. Field of the Invention

The present invention relates to:

A. A process for the preparation of pile ware utilizing a single needle bed warp knitting machine, having pile sinkers, in which during the swing-through of the guides subsequent to the underlap, into the overlap position, first the ground threads and then the left pile threads are laid to the rear of the needles, and upon these needles with separation from each other, and in which the pile sinkers during or after the swing-through are introduced in the space between the needle ground threads and the left pile threads, and stay there until the knock-over of the stitch.

B. The fabric produced thereby.

C. A warp knitting machine for the production of such pile ware, comprising a needle bar, sidewardly displaceable guide bars for ground and left pile threads and a pile sinker bar whose pile sinkers may be swung into the needle gaps for the purpose of pile production, and thus may be led into the space between the ground threads and the left pile threads. When used to describe the fabric sides, the left and right refer to the technical back and technical face, respectively.

2. Description of Related Art

Such a procedure and such a warp knitting machine having pile sinkers moveable into the needle gaps are known from DE 38 278 265 C2. The pile sinkers are provided with a separation of one needle space. The guide bars are fully charged with ground and pile threads. There is thus provided a dense pile on the left side of the fabric.

In DE 11 88 754 C, it is known to anchor the pile threads in a first working cycle by stitch formation in the fabric ground and in the subsequent working cycle to lay threads around needles not participating in the formation of the ground ware, from which they are knocked over. This leads to a fabric having a half pile density. When the pile loops are located on the left side of the fabric, the loops must be additionally mechanically raised, for example, by means of a brush arrangement.

In DE 42 23 226 C2, there is a disclosure of the production of pile ware having pile provided on both sides of the fabric. For this purpose, pile sinkers resting permanently in the needle gaps are utilized by means of which the pile loops are provided to the left side, whereas on the opposite side loops are formed with the assistance of an additional hook bar. This latter however leads to a lower production speed since in the overlap phase utilizing the hooks, the thread reserve must be formed which leads to an interval in the stitch building process. Since, because of the positioning of the pile sinkers in the needle gaps, it is only possible to consider certain lapping patterns of ground threads, for example tricot, one can only obtain higher stability by means of additional weft threads, which stretch over the entire width of the machine, which necessitate the corresponding feeding arrangements.

The purpose of the present invention is to provide a new type of warp knitted fabric having pile loops on both sides thereof.

SUMMARY OF THE INVENTION

In accordance with the illustrative embodiments demonstrating features and advantages of the present invention, there is provided a process for the preparation of pile ware from pile threads and ground threads by using a warp knitting machine. This machine has a single needle bed with a plurality of needles, a plurality of pile sinkers about half as numerous as the needles, and a plurality of guide bars each having a plurality of guides. The process includes the step of threading alternating ones of the guides for each of the guide bars, to bring only every second needle into service for stitch formation. Another step is forming left pile loops by: (A) During the swing-through of the guides subsequent to the underlap into the overlap position, laying first the ground threads and then the pile threads, to the rear of the needles, to run along the needles with separation between the ground threads and the pile threads. (B) Introducing the pile sinkers into the space between the ground threads and the pile threads, during or after the swing-through, to remain there until the knock-over of the stitch. The process also includes the step of providing pile threads and ground threads and forming right pile loops by having the pile threads: (a) overreached by the pile sinkers and laid about needles not serving for stitch formation, and then (b) knocked over.

According to another aspect of the invention, knitted fabric is provided comprising threads, including pile threads and ground threads. The pile threads are formed into pile loops on the left and right sides of the fabric using the foregoing process.

According to still another aspect of the invention, a warp knitting machine is provided for the formation of pile ware from ground threads and pile threads. This machine has a needle bed with a plurality of needles. The machine also has a plurality of laterally displaceable guide bars, each having a plurality of guides for guiding the ground threads and the pile threads. The guides for each of the guide bars is alternately threaded to bring only every second needle into service for stitch formation. Also included is a pile sinker bar having a plurality of pile sinkers about half as numerous as the needles. The sinkers are swingable between the needles for introduction into a space between the ground threads and the pile threads for the purpose of pile formation. The machine also includes a displacement means for controlling displacement of the guide bars. Also included is a control means for providing pile threads (a) in a position to be overreached by pile sinkers, and (b) that are laid, prior to knock-over, about needles that are out of service for stitch formation.

According to still another further aspect of the invention, knitted fabric is provided, comprising ground threads and pile threads formed into (a) left pile loops by pile threads on pile sinkers that overreach ground threads during knock over, and (b) right pile loops by pile threads knocked off from needles that are not in service for stitch formation.

The foregoing achieves processes, machines and fabrics having advantages over the prior art are achieved. In a preferred procedure the threads are provided to the guides in a "one full/one empty" fashion. Only every second needle serves for the formation of stitches and the number of pile sinkers equals half the number of needles. Furthermore, right pile threads are provided which are over-gripped together with the ground threads by the pile sinkers, and are not laid around the stitch forming needles and then knocked over.

In this procedure, the left pile loops are produced in the conventional manner with the assistance of pile sinkers introduced into the needle gaps. These left pile loops stand upright and can be very readily sheared, for example, for the production of velours. For the production of the right pile loops which result from the knock-over of needles not participating in stitch formation, the threads are provided "one full/one empty" to the appropriate guides and the pile sinkers are provided in a separation of double the needle spacing. A pile loop is provided to the left and to the right side in every second work cycle, with the result that, if no further steps are taken, there is provided a fabric with equal number of pile loops on the right and on the left which is desirable, for example, in toweling material. This provides a method of producing very stable pile ware.

In most cases it is desirable that the left and the right pile threads are each formed from their own pile thread system. This makes it possible to provide piles of different colors on the left and on the right.

In another alternative, the left and the right pile threads may be alternating segments of the same pile thread system. In this procedure, use is made of the fact that the left and the right pile threads only form loops in every second working cycle. By means of such a single pile system, it is possible to place the same number of pile loops on each side as with two pile thread systems.

In this connection, it is desirable that the pile system, contains a Koeper binding for the fixation of the pile loops formed by knock-over. This ensures that the right loops are not pulled back by the subsequent machine steps.

Effectively, stationary pile sinkers are arranged in alternate needle spaces and form pile in one working cycle and not in the subsequent working cycle. This can lead to a patterning through a displacement control of the pile sinkers in which, by choice, the pile loops can be formed or suppressed on the left side.

A further patterning possibility exists, in that by the displacement control of the guide bar for the left pile threads, as desired, pile loops can be formed or suppressed on the left side.

Yet another possibility exists in that by the displacement control of the guide bar for the right pile threads, at choice, pile loops can be formed or suppressed on the right side. This gives rise to a strip-formed patterning across the width of the fabric.

A patterning within the stitch row is possible in that (a) by means of jacquard control, the guides for the pile threads can form pile loops on the left side or be suppressed, and/or (b) by means of jacquard control of the guides for the right pile threads, at choice, pile loops may be formed or suppressed on the right side.

In some cases, it is desirable to provide an elastic partial weft insert thread to the ground threads. By means of such partial weft threads, the fabric is pulled together in the transverse direction so that despite the provision of threads in a "one full/one empty" manner to the appropriate guides, there is provided a high fabric density.

The procedure may be achieved by setting up a warp knitting machine described as above in the following manner: The guide bars having a thread provision of "one full/one empty" are controllable in such a manner that: (a) stitch formation only occurs on each second needle, (b) the feed mechanism for the right pile threads is provided with a control means so that the pile threads are over-gripped by the pile sinkers in order that they not be laid around the stitch forming needles and are then knocked-over, and (c) the number of pile sinkers is equal to half the number of the needles.

Preferably, the pile sinker bar is displaceable in the longitudinal direction.

It is further desirable that the guides for the left and/or the right pile threads are displaceable by one needle space by means of a jacquard control.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein.

FIGS. *6a* through *6f* illustrate six different embodiments for pile formation on both sides of the fabric.

DETAILED DESCRIPTION OF THE PREFERRED EMBODIMENTS

Figure 1:
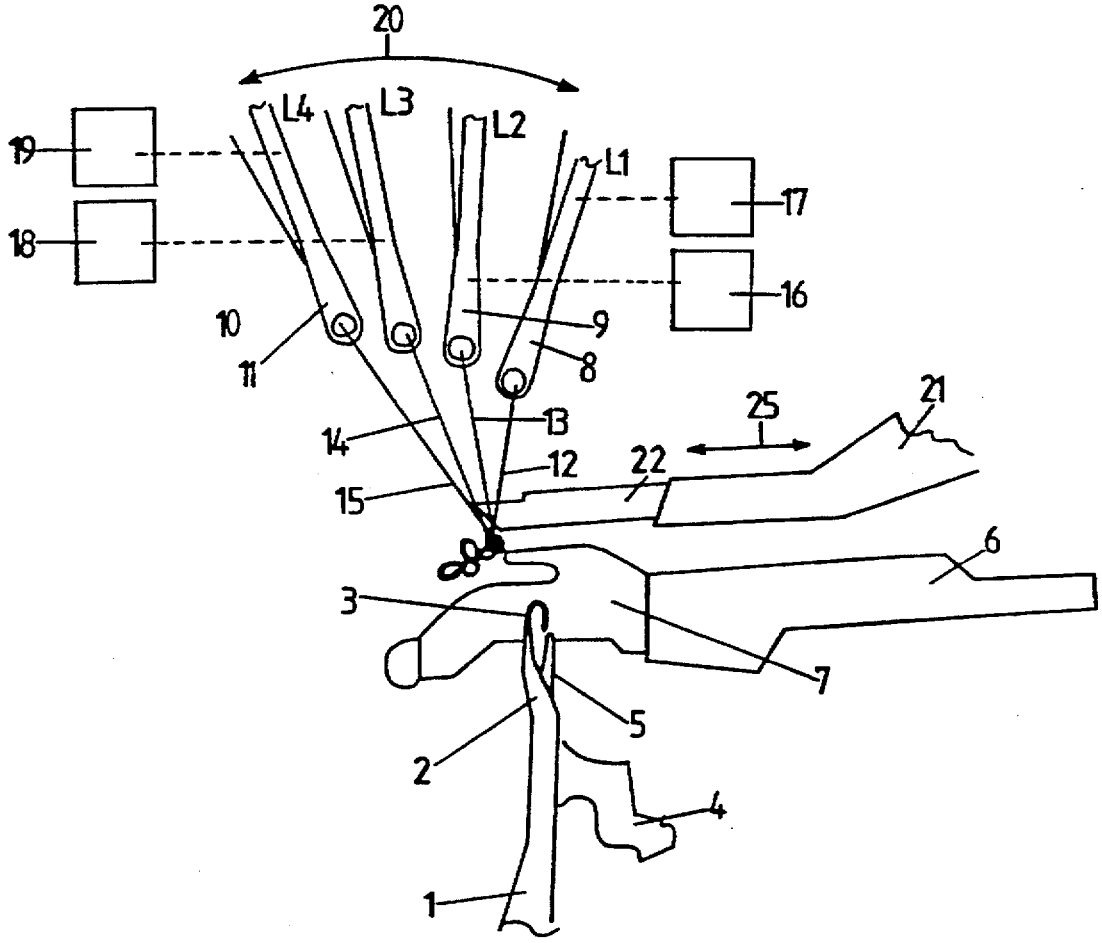
FIG. 1 is a schematic, side elevational view of the working area of a warp knitting machine used herein.

FIG. 1 shows a needle bar (1) having a plurality of needles (2) and the hooks (3) corresponding thereto. A slider bar (4) carries a plurality of slides (5) to close the hook space. In place thereof, there may also be employed lace needles, tongue needles or the like. A further bar (6) carries the closing knock-over sinkers (7). There are provided four guide bars L1, L2, L3 and L4 with corresponding guides (8) through (11). These guides provide threads (12) through (15), which are displaceable by displacement control arrangements (16) through (19), respectively. Arrangements 17 and 19 have jacquard controls *17a* and *19a* for displacing guides by one needle space. Furthermore, these guides L1 through L4 are displaceable out of the illustrated underlap position into the overlap position and may swing back as illustrated by arrow (20).

Figure 2:
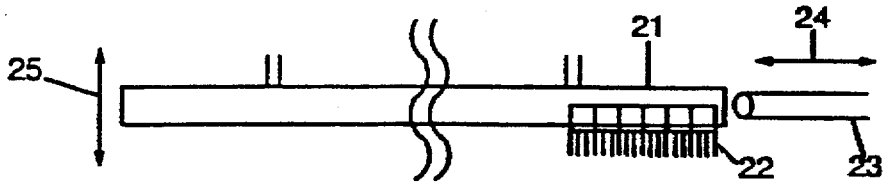
FIG. 2 is a schematic, plan view of the pile sinker bar of FIG. 1.

A pile sinker bar (21) carries a plurality of pile sinkers (22) whose separation corresponds to two needle spaces. The pile sinker bar (21) is, as shown in FIG. 2, provided with a displacement control arrangement (23) similarly operating in the longitudinal direction, that is to say, to and fro in the direction of arrow (24). Furthermore, it is displaceable as illustrated in FIG. 1 in the direction of arrow (25), out of the illustrated position in which it is found in the needle gaps into a retracted position in which it is located outside the needle gaps and movable back thereinto. As is described in detail in DE 38 27 265 C2, this movement in the needle gaps occurs when during the swing-through into the overlap position, the threads, with separation from each other, run along the back of the needle so that the rearmost thread (15) (or the rearmost threads) are located above the pile sinker (22) and thus form a pile whereas the remaining threads are gripped under the pile sinker (22).

Figure 3:
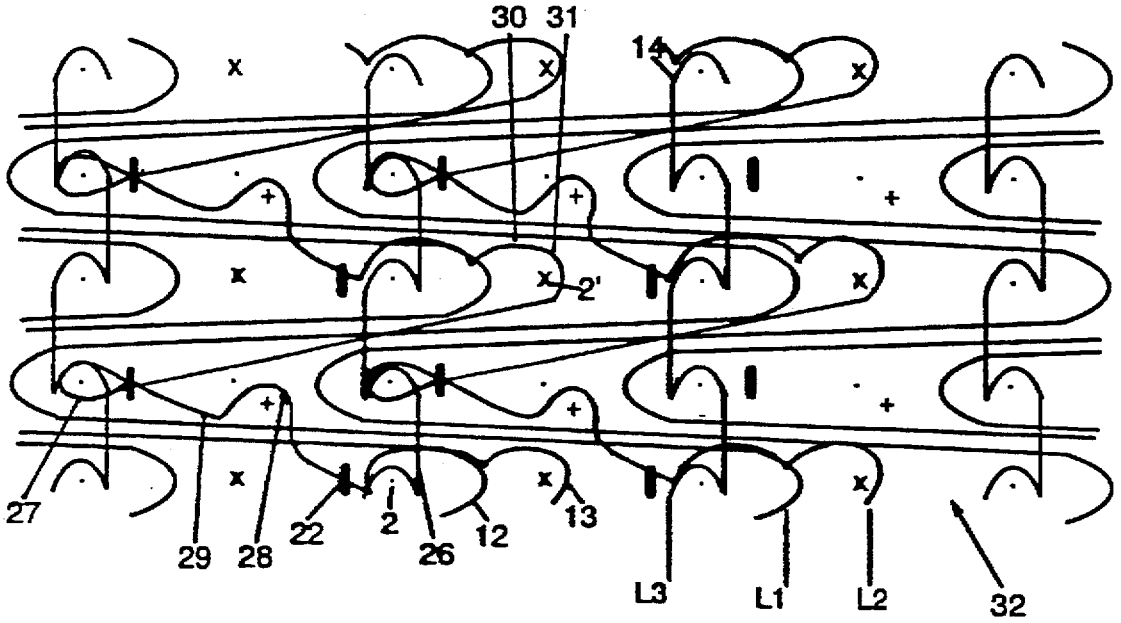
FIGS. 3 through 5 are lapping diagrams for three different pile fabrics, which can be produced in accordance with the present invention.
Figure 4:
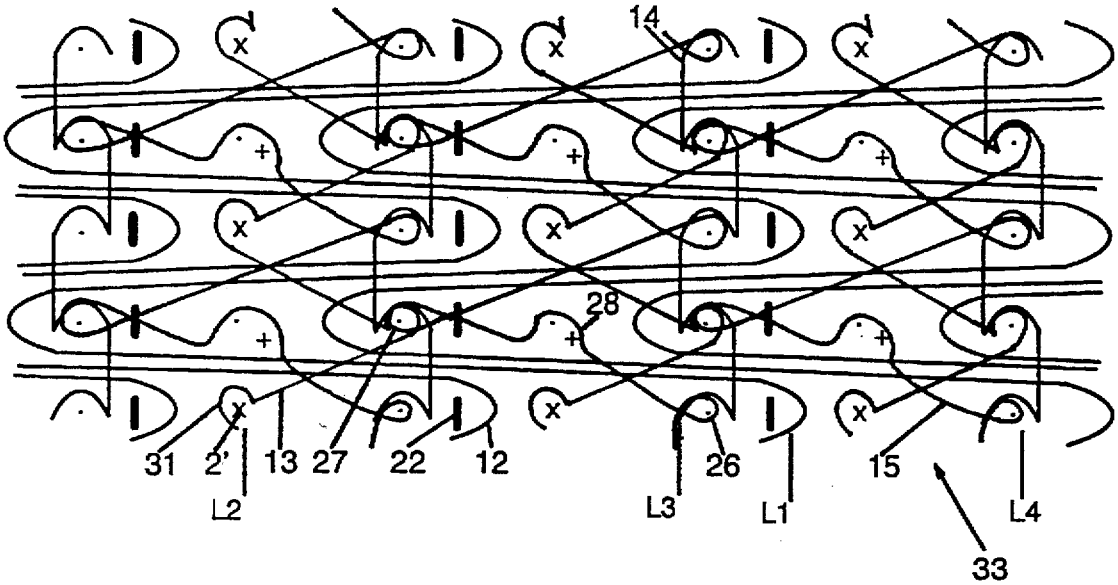
Figure 5:
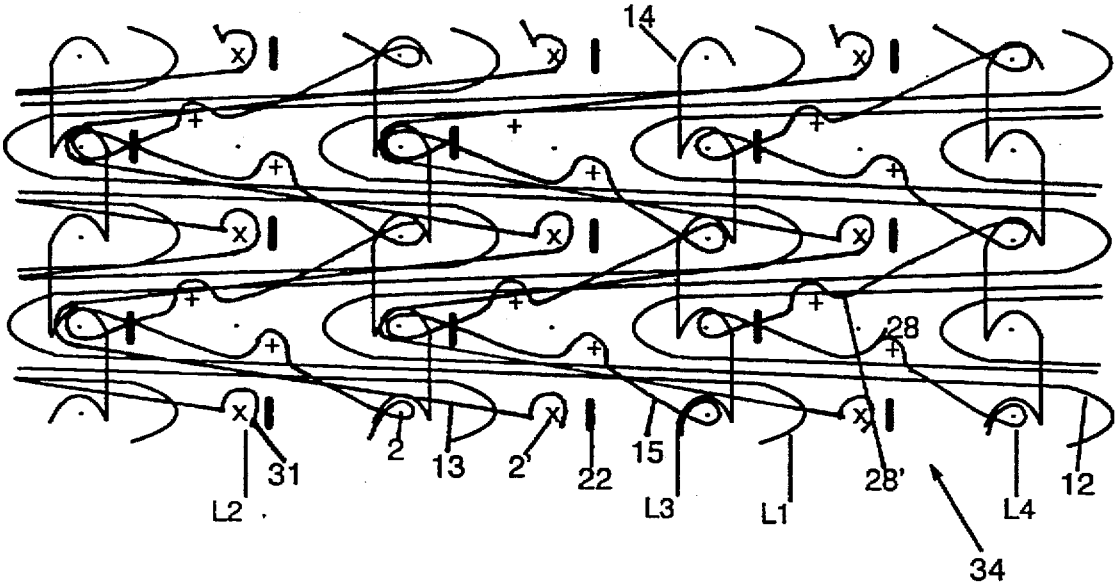

The lapping diagrams of FIGS. 3 through 5 are, in the usual manner, to be read from bottom to top. The needles (2) of a stitch row are indicated by dots and the pile sinkers (22) by heavy lines. The symbol "+" means the formation of a pile loop on the left side, with the assistance of a pile sinker. The symbol "x" indicates the formation of a pile loop on the right side by knock-over of a needle (2) not provided with a stitch. The designation "left pile loop" and "right pile loop" designates the pile loops on the left and the right side of the fabric, respectively. The designation "left pile thread" and "right pile thread" refers to the pile threads appropriate for the formation of the correspondingly named pile loops, and these threads may be part of the same or different systems, depending upon the specific embodiment.

In FIG. 3, only guides bars L1, L2 and L3 are in operation. The following displacement regimen applies:

| | | |
|---|---|---|
| Pile Sinker Bar 21: | 0-0-0 / 1-1-1 // | |
| L1: | 0-0-0 / 5-5-5 // - Ground | 1 empty/1 full |
| L2: | 0-2-2 / 3-4-3 // - Loop | 1 full/1 empty |
| L3: | 1-0-0 / 0-1-1 // - Ground | 1 full/1 empty |

Thus, L1 lays a first ground thread (12) in the form of a partial weft insert of threads of elastic material running over five needle spaces. L3 lays a ground thread (14) as "Franse." Only every second needle (2) is provided with a stitch. The needles (2') lying therebetween do not serve for stitch formation so that the threads laid off on them are knocked over during the next work cycle. Only a single system of pile threads (13) is laid by L2. They form, during the first working cycle, a stitch (26) and during the following work cycle, a stitch (27) which is generated on the second needle (2) over. Therebetween, there is generated a left pile loop (28), since the pile thread segment (28) is gripped upon the pile sinker (2).

Subsequently, the pile thread (13) is then stitched in by being looped around needle (2') (not participating in the stitch formation) by needle (2). This second segment (30) of pile thread (13) thus generates a pile loop (31) on the right side of the fabric by knock-over. In Segment (30), a Koeper binding is provided. This ensures that the right loop (31) is provided with a certain fixation and therefore is not pulled back by the subsequent stitch formation process. During the second work cycle, the pile threads (13) may not be grasped by the appropriate pile sinker (22). For this reason, the pile sinker bar (21) is displaced in the longitudinal direction by control arrangement (23).

Figure 6A:
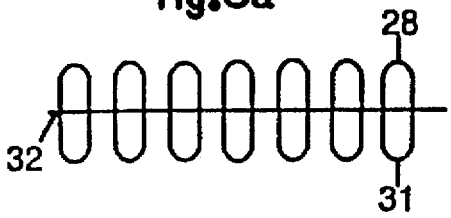

Since in each working cycle there is provided a pile loop and alternating between the left and right side, there is provided a pile fabric (32) as illustrated in FIG. 6*a*.

The lapping diagram of FIG. 4 shows pile fabric (33) which similarly has an equal number of pile loops on the right and on the left side as in pile fabric (32). Here, the following displacement program is utilized:

| | | |
|---|---|---|
| Pile Sinker Bar 21: | 0-0-0 / 0-0-0 // | |
| L1: | 0-0-0 / 5-5-5 // - Ground | 1 full/1 empty |
| L2: | 2-1-1 / 0-1-1 // - Right Loop | 1 full/1 empty |
| L3: | 1-0-0 / 0-1-1 // - Ground | 1 empty/1 full |
| L4: | 1-0-0 / 2-3-3 // - Left Loop | 1 empty/1 full |

The ground of FIG. 4 is laid by L1 and L3 in a manner similar to that of FIG. 3. The pile sinkers (22) are, in this case, not displaceable in the longitudinal direction. This has the consequence that the left pile threads (15) laid by L4 during the change from a first stitch (26) to a second stitch (27) are laid as a pile loop (28) by means of pile sinker (22). On the other hand, during the change from stitch (27) to stitch (26), this does not take place.

L2 forms a provision arrangement of the right pile thread (13), which is stitched in the area of stitch (27) and subsequent thereto is laid about a needle (2') that does not participate in stitch formation, so that a right pile loop (31) is formed.

The embodiment of FIG. 5 shows a fabric (34) which is formed in accordance with the following displacement protocol:

| | | |
|---|---|---|
| Pile Sinker Bar 21: | 0-0-0 / 2-1-1 // | |
| L1: | 0-0-0 / 5-5-5 // - Ground | 1 full/1 empty |
| L2: | 0-1-1 / 4-4-4 // - Right Loop | 1 full/1 empty |
| L3: | 1-0-0 / 0-1-1 // - Ground | 1 empty/1 full |
| L4: | 1-0-0 / 2-3-3 // - Left Loop | 1 empty/1 full |

In this modification the pile sinkers (22) are displaced by one needle space during each work cycle. At the beginning of each second work cycle, there occurs a short withdrawal movement in which the pile sinker bar is displaced from gap (0) to gap (2) and back to gap (1). L1 again lays a ground thread (12) as a partial weft insert over five needle spaces. L3 lays a further ground thread (14) as "Franse." The right pile thread (13) laid by L2 is tied off on the one hand on needle (2) and on the other hand, is laid about the needle (2') (not participating in stitch formation), so that a right pile loop (31) results.

The left pile thread (15) laid by bar L4 is alternately stitched in by stitch forming needle (2). Since the pile sinkers (22) are moved to and fro, left loops (28) and (28') are formed during each work cycle. The illustrated movement of the pile sinker bar leads thereto in that it operates as a hold-down sinker, which holds down the right loop formed by L2, so that this right loop cannot be pulled onto the technically left side of the fabric.

Figure 6B:
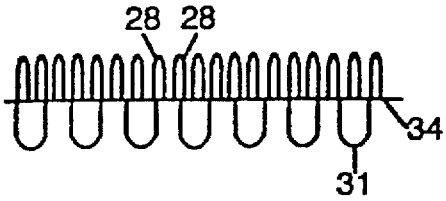

The corresponding pile ware (34) is illustrated in FIG. 6*b*.

Figure 6C:
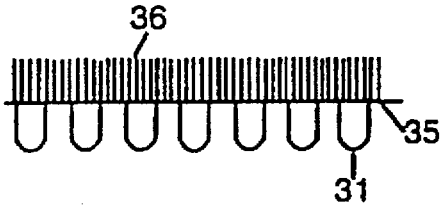

The thus produced pile loops (28) and (28') may be readily sheared so that a pile fabric (35) is provided which has velour on one side and on the other side, right pile loops (31). This sheared product is illustrated in FIG. 6*c*.

Figure 6D:
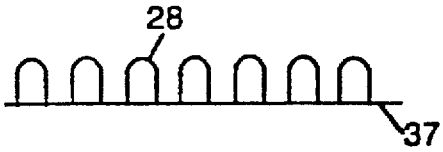

FIG. 6*d* shows a pile fabric segment (37), that only carries left pile loops (28). Here, the right pile loops are suppressed in that the control arrangement (19) so displaces the guide bar L4, that the pile threads (15) are only laid off on needles (2), which serve for stitch formation.

Figure 6E:
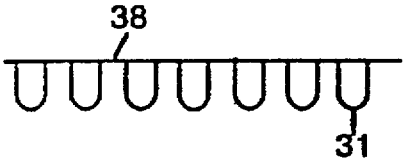

FIG. 6*e* shows a pile fabric segment (38) which has only right pile loops (31), that is, a situation in which the left pile loops are suppressed. This occurs either when guide bar L2 is displaced by control arrangement (16), or pile sinker bar (21) is displaced by control arrangement (23), in such a manner that the left pile threads (15), as well as the other threads, are over-gripped by pile sinker (22). In this manner, a stripe pattern in the pile may be obtained.

Figure 6F:
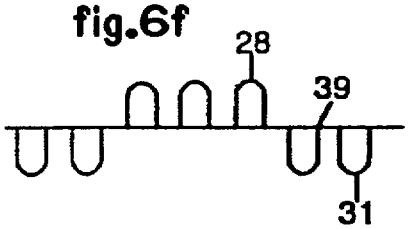

FIG. 6*f* shows a pile fabric (39) in which a desired patterning is obtained, since the formation or suppression of individual pile loops (28) and (31) are individually prescribed. This is achieved in that the guides of pile threads (13) and/or (15) are additionally subjected to jacquard control so that the guides (9) and (11) may be individually displaced.

By utilization of a partial weft thread insert running over five needles spaces, there is provided a dimensionally stable ground fabric for the most diverse uses, for example, for bath coats. By utilizing elastic threads, there is provided a fabric of higher elasticity which can be used for clothing and sports textiles. Since different lapping possibilities can also be alternately utilized, a very large number of different pile formations are possible. The loop length, that is to say, the pile height on the left side of the goods can be obtained by utilizing different heights of pile sinkers and/or by different underlap lengths and binding of the appropriate pile thread guide bars.

Obviously, many modifications and variations of the present invention are possible in light of the above teachings. It is therefore to be understood that within the scope of the appended claims, the invention may be practiced otherwise than as specifically described.

We claim:

1. A process for the preparation of pile ware from pile threads and ground threads by using a warp knitting machine, having a single needle bed with a plurality of needles, a plurality of pile sinkers about half as numerous as said needles, and a plurality of guide bars each having a plurality of guides for swinging between an underlap position and overlap position to perform an underlap and overlap, respectively, comprising the steps of:

threading alternating ones of the guides for each of the guide bars, to bring only every second needle into service for forming a stitch;

forming left pile loops by:

(a) during a swing-through of the guides subsequent to the underlap into the overlap position, laying first the ground threads and then the pile threads, to the rear of the needles, to run along the needles with separation between the ground threads and the pile threads; and (b) introducing the pile sinkers into the space between the ground threads and the pile threads, during or after the swing-through, to remain there until the stitch is knocked-over; and providing pile threads and ground threads and forming right pile loops by having the pile threads:

(a) overreached by the pile sinkers and laid about the needles located between the needles serving for stitch formation; and then (b) knocked over.

2. The process in accordance with claim 1 wherein the forming of the left pile loops and the right pile loops are performed with separate pile thread systems.

3. The process in accordance with claim 1 wherein the forming of the left pile loops and the right pile loops are performed alternately from a single pile thread system.

4. The process in accordance with claim 1 wherein the forming of right pile loops is performed with a Koeper binding for fixing the right pile loops created during knock-over.

5. The process in accordance with claim 1 comprising the step of:

displacing the pile sinkers in successive work cycles by one needle space.

6. The process in accordance with claim 5 comprising the step of:

momentarily displacing the pile sinkers by another needle space and then back again, in order to fix the pile loops formed during knock-over.

7. The process in accordance with claim 1 comprising the step of:

forming or stressing the left pile loops by displacing the pile sinkers in a needle to needle direction.

8. The process in accordance with claim 1 comprising the step of:

controlling displacement of one of the guide bars guiding the pile threads in order to selectively form or suppress the left pile loops.

9. The process in accordance with claim 1 comprising the step of:

controlling displacement of one of the guide bars guiding the pile threads in order to selectively form or suppress the right pile loops.

10. The process in accordance with claim 1 employing a jacquard control, and comprising the step of:

controlling selected ones of the guides on one of the guide bars guiding the pile threads in order to selectively form or suppress the left pile loops.

11. The process in accordance with claim 1 employing a jacquard control, and comprising the step of:

controlling selected ones of the guides on one of the guide bars guiding the pile threads in order to selectively form or suppress the right pile loops.

12. The process in accordance with claim 1 comprising the step of:

displacing one of the guide bars in a manner to lay partial weft inserts with elastic threads.

13. A warp knitting machine for the formation of pile ware from ground threads and pile threads, comprising:

a needle bed having a plurality of needles;

a plurality of laterally displaceable guide bars each having a plurality of guides for guiding the ground threads and the pile threads, said guides for each of the guide bars being alternately threaded to bring only every second needle into service for stitch formation;

a pile sinker bar having a plurality of pile sinkers about half as numerous as said needles, said sinkers being swingable between the needles for introduction into a space between the ground threads and the pile threads for the purpose of pile formation;

displacement means for controlling displacement of the guide bars; and control means for providing the pile threads (a) in a position to be overreached by the pile sinkers, and (b) in a position to be laid, prior to knock-over, about needles that are out of service for stitch formation.

14. Warp knitting machine in accordance with claim 13 wherein the pile sinker bar is mounted for longitudinal displacement.

15. Warp knitting machine in accordance with claim 13 comprising:

a jacquard control for displacing selected ones of the guides for the pile threads by one needle space.

* * * * *